United States Patent [19]

Forbes et al.

[11] Patent Number: 4,482,890

[45] Date of Patent: Nov. 13, 1984

[54] WEIGHT RESPONSIVE INTRUSION DETECTOR USING DUAL OPTICAL FIBERS

[75] Inventors: George M. Forbes, Welling; Robert J. Seaney, Tonbridge Wells, both of England

[73] Assignee: The Secretary of State for Defence in Her Britannic Majesty's Government of the United Kingdom of Great Britain and Northern Ireland, London, England

[21] Appl. No.: 340,250

[22] Filed: Jan. 18, 1982

[30] Foreign Application Priority Data

Jan. 22, 1981 [GB] United Kingdom ..... 8101881

[51] Int. Cl.[3] ..... G08B 13/22

[52] U.S. Cl. ..... 340/556; 250/227; 340/557; 340/600; 340/666

[58] Field of Search ..... 340/556, 666, 600, 557; 250/227; 350/96.31, 96.3, 96.29; 455/612, 610

[56] References Cited

U.S. PATENT DOCUMENTS 4,292,628 9/1981 Sadler ..... 340/556
4,297,684 10/1981 Butter ..... 340/566
4,418,338 11/1983 Burt ..... 340/600

FOREIGN PATENT DOCUMENTS 1497995 1/1978 United Kingdom .
2009396 6/1979 United Kingdom .
2015844 9/1979 United Kingdom .
2058394 4/1981 United Kingdom .

*Primary Examiner*—Glen R. Swann, III
*Attorney, Agent, or Firm*—Cushman, Darby and Cushman

[57] ABSTRACT

An intruder detection system wherein light pulses are fed from a light source to a detector via a transmitting optical fibre, an optical terminator and a receiving optical fibre, both fibres being either stepped index fibres or poor quality graded index fibres. The fibres are disposed in intimate contact throughout their length within a cable, and compression of the cable at any region of its length sufficient to cause microbending permits light pulses to breakthrough from one fibre to the other. The time interval between arrival at the detector of a light pulse received from the source after passage through the total length of the transmitting fibre and the receiving fibre, and arrival of a breakthrough pulse received after passage through the fibres only so far as the region of microbending and back again, is indicative of the location of the compresion. The cable may be laid around the perimeter of a site to be guarded so that compression will occur when an intruder crosses the cable. The system is not susceptible to interference and infra-red light pulses may be used to make the system totally covert.

12 Claims, 3 Drawing Figures

WEIGHT RESPONSIVE INTRUSION DETECTOR USING DUAL OPTICAL FIBERS

BACKGROUND OF THE INVENTION

This invention relates to an intruder detection system capable of convertly sensing and indicating the entry point of an intruder into a selected area, a factory site for example.

Intruder detection systems are known in which two wires comprising a transmitting wire and a receiving wire are buried together around the perimeter of a site to be protected. Radio frequency or microwave signals are sent out along the transmitting wire from a control point and received back via the receiving wire. Crossing of the two wires at any point by an intruder causes an increase in coupling between them and a consequent increase in the signal received at the control point. Disadvantages of such systems are that two wires need to be buried, the coupling between them varies with their length and with soil conditions (which vary hour by hour) making the nature of a disturbance difficult to determine, and the transmitted signal is both detectable and can be interfered with by the intruder.

Optical fibres are known for use in covert and secure transmission systems. In such systems light signals are transmitted along the length of a cylindrical transparent core encased by an integral cladding of lower refractive index than the core, which cladding maximises total internal reflection of the light signals at the core/cladding interface, thereby to minimise signal loss from the core. A known deficiency of optical fibres having an abrupt refractive index step between the core and the cladding, i,e., stepped-index fibres, is the loss of light that can occur through the cladding if the fibre is subjected to localised bending sufficient to cause a decrease in the angle of incidence of the light at the core/cladding interface in the region of bending, to less than the critical angle for total internal reflection, herein referred to as 'micro-bending'. This effect is usually minimised in optical fibres for telecommunication purposes by the use of more expensive graded-index fibres having a progressively reducing refractive index from the central core to the cladding, thus avoiding abrupt transitions.

SUMMARY OF THE INVENTION

It is an object of the present invention to use the hitherto disadvantageous effect of micro-bending in order to provide a covert intruder detection system which is secure from interference and sensitive both to intruder entry point location and to intruder type.

According to the present invention the intruder detection system includes:

a pulsed light source, at least two optical fibres each having a core and a cladding a lower refractive index than the core, one being arranged as a light transmitting fibre for conducting light pulses away from the source, and the other being arranged as a light receiving fibre disposed adjacent the transmitting fibre with the respective claddings in intimate contact substantially throughout their length, and a light pulse detector arranged for receiving light pulses conducted along the receiving fibre.

In use, if the transmitting and receiving fibres are subjected to pressure so that they are squeezed together at any location along their length, the micro-bending that results disrupts total internal reflection at the location and permits 'breakthrough' light pulses to escape from the transmitting core and to enter the receiving core via the two interjacent claddings.

Both the transmitting and the receiving fibres may be conveniently contained in a single, flexibly sheathed cable which may be laid or shallowly buried around the perimeter of a site to be protected, the cable being so disposed as to ensure that radial pressure exerted from above acts to compress the transmitting and the receiving fibres together. Preferably a cable configuration in which an annular array of receiving fibres surrounds a central bundle of transmitting fibres may be used so as to provide omni-radial sensitivity and thereby permit the cable to be laid in any disposition. Alternatively, the fibres may be arranged as a multiplicity of coaxial annular arrays alternately connected as transmitters and receivers.

The refractice indices of the claddings of both the transmitting and the receiving fibres are preferably identical and an optical coupling media may be applied between them.

Conveniently the source and the detector may both be situated at the same end of the cable and the system may additionally include an optical terminator. Located at the other end of the cable and arranged for directing the light pulses conducted through the transmitting fibre from the source back into the receiving fibre for conduction to the detector.

The light pulses thus returned to the detector serve to conform correct functioning of the system and further provide a time-frame against which the arrival of break-through pulses at the detector can be measured, the time interval occurring between transmission of a light pulse from the source and arrival of a break-through pulse at the detector being indicative of the distance travelled through the fibres and hence of the location of a disruption.

Alternatively, the source and the detector may be situated at opposite ends of the cable, an optical coupler being provided to input the light pulses from the source additionally to the receiving fibre.

The light source preferably operates at infra-red wavelengths to as to minimise the likelihood of detection by an intruder should the cable become breached.

BRIEF DESCRIPTION OF THE DRAWINGS

An embodiment of the invention will now be described by way of example only with reference to the accompanying drawings in which.

DETAILED DESCRIPTION OF THE PREFERRED EMBODIMENT

Figure 1:
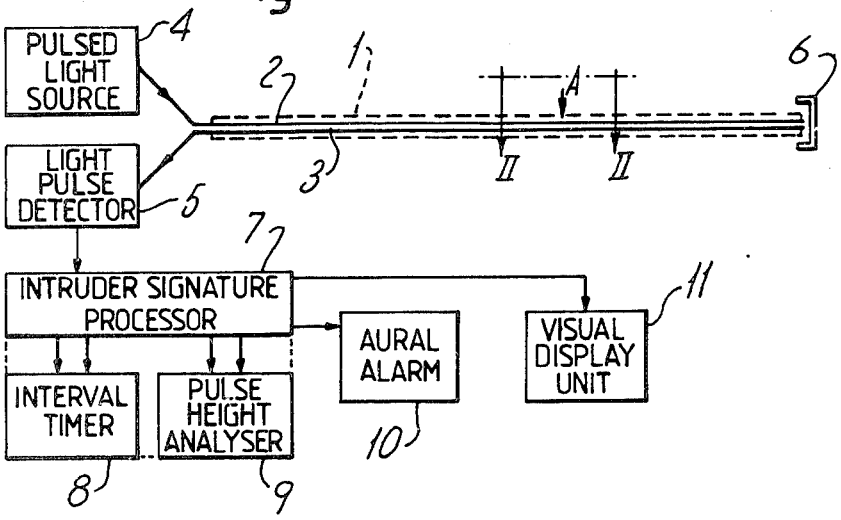
FIG. 1 is a diagrammatic representation of an intruder detection system having a twin fibre cable.

The detection system represented in FIG. 1 includes a cable 1 which, (for ease of description) contains only two fibres, a light transmitting fibre 2 and a light receiving fibre 3. At one end of the cable 1 the transmitting fibre 2 is coupled with a pulsed light source 4 and the receiving fibre 3 is coupled with a light pulse detector 5.

At the other end of the cable 1 an optical terminator 6 directs light rays conducted through the fibre 2 from the source 4 back into the receiving fibre 3 for conduction to the detector 5. Associated with the detector 5 is an intruder signature processor 7, a visual display unit 11 and an aural alarm 10. The processor 7 includes a pulse height analyser 9 and an interval timer 8.

The cable 1 is laid around the perimeter of a site to be protected and in use, provided that no disturbance of the cable occurs, light pulses emitted at the source 4 are received back at the detector 5 after a time delay equal to twice the length of the cable divided by the speed of light.

Figure 2:
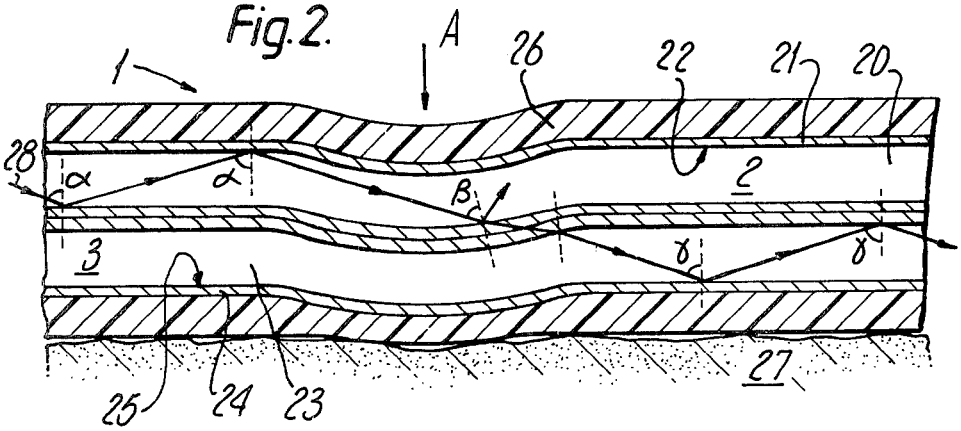
FIG. 2 is an axial section through the portion II—II of the twin fibre cable of FIG. 1, diagrammatically illustrating the effect of local compression upon passage through the cable of a single light ray and, FIG. 3 is a cross section through an alternative multi-fibre cable.

The fibres 2 and 3 within the cable 1 are identical and are illustrated in greater detail in FIG. 2. (The fibres shown, and now discussed, are stepped-index fibres but poor quality graded-index fibres may be alternatively employed at low cost with similar effect.) The transmitting fibre 2 comprises a core 20 having a cladding 21 of lower refractive index than the core 20, and a core/-cladding interface 22. The receiving fibre 3 is of identical construction and comprises a core 23 having a cladding 24 and a core/cladding interface 25. Both fibres are contained in a flexible sheath 26 which is laid upon a surface 27. Anyone stepping upon or driving over the cable 1, e.g. at point A, will compress the cable and whereby cause a region of micro-bending in that locality.

The effect of this micro-bending upon the operation of the system is illustrated in FIG. 2 by means of a single light ray 28 which has been transmitted along the length of the core 20 from the source 4 by repeated reflexion at the interface 22, the angle $\alpha$ subtended by the ray 28 with the normal to the interface, i.e. is the angle of incidence, being greater than the minimum angle of incidence at which total internal reflection occurs, i.e. the critical angle $\alpha$ (not shown).

When the ray 28 reaches the region of compression, because the interface 22 has become abruptly tilted with respect to the preceding region of interface 22, the angle of incidence is decreased from $\alpha$ to $\beta$. Provided that $\beta$ is less than $\theta$ the ray will then be no longer totally internally reflected and a major component of the ray will be refracted through the claddings 21 and 24 to enter the core 23 to the receiving fibre 3. This breakthrough ray is thereafter transmitted along the core 23 towards the terminator 6 by repeated total internal reflection at the interface 25, its angle of incidence $\gamma$ being once again greater than the critical angle $\theta$.

All the light rays that break through from the fibre 2 to the fibre 3 at the region of compression during one light pulse, together provide a breakthrough pulse which is also transmitted back along the fibre 3 directly to the detector 5. Such directly returned breakthrough pulses will of course arrive at the detector out of phase with their progenitor pulses which must travel the full length of the cable before returning. Consequently the time displacement between a breakthrough pulse and its progenitor pulse is a direct indication of the distance along the cable of the compression point A from the detector 5. The amplitude of the breakthrough pulses and their number are respectively dependent upon the extent of the micro-bending, i.e. the ground pressure exerted by an intruder, and its duration. Consequently the information available in the breakthrough pulses is indicative of intruder type as well as intruder location. Further, multiple compressions can be recognised by multiple time displacements, and their separations contain additional information, e.g. the wheel or axle spacing of an intruding vehicle or separate crossings of several intruders.

All this information can be analysed and displayed in a variety of ways, one simple example being that illustrated in FIG. 1. The optical pulses received are converted by the detector 5 to electrical pulses which are fed to the intruder signature processor 7, the output of which is coupled to the visual display unit 11 and the aural alarm 10. The visual display may conveniently comprise a map of the site on which the type and location of the intruder may be observed by a security guard when his attention is drawn by the sounding of the aural alarm.

Figure 3:
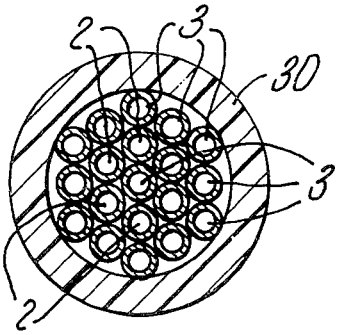

Obviously multi-fibres are desirable for achieving useful light levels in the detection system and one example of such a cable arrangement is illustrated in FIG. 3. This arrangement comprises a central receiver fibre 3 surrounded by an annular array of transmission fibres 2, further surrounded by an annular array of receiver fibres 3. In use all the receiver fibres 3 are coupled in parallel and connected as the corresponding single fibre illustrated in FIG. 1, as also are the transmission fibres 2. It will of course be apparent that many more alternating annuli can be employed. All the fibres are closely packed within a flexible sheath 30 which can be selected to provide resistance to abrasion and water, and also to provide appropriate camouflage.

Cables of several kilometers in length can be employed without unacceptable loss in efficiency due to attenuation, glass or silicon cores being preferable to polymer cores in this respect. The cable is easily deployed and relatively inexpensive in comparison with the high quality graded-index cables normally employed for telecommunication purposes. Some optical coupling will inevitably occur between the transmitting and the receiving fibres throughout their length, pulses breaking through at permanent bends in the cable for example, but these comprise a constant background level which is readily countered in the processing system.

The pulsed light source 4 may conveniently be a solid state light emitting diode or a laser, preferably operating at infra-red wavelengths for totally covert application, in which case the associated optical components must of course all be selected to have appropriate IR transmission characteristics. The pulse width is preferably in the nanosecond region and the spacing between the pulses sufficient to permit full analysis and presentation, e.g. a pulse/space ratio of about 1 to 10.

We claim:

1. An intruder detection system including a pulsed light source, at least two optical fibres each having a core and a cladding of lower refractive index than the core, one being arranged as a light transmitting fibre for conducting light pulses away from the source, and the other being arranged as a light receiving fibre disposed adjacent the transmitting fibre with the respective claddings in intimate contact substantially throughout their length, and a light pulse detector arranged for receiving light pulses conducted along the receiving fibre.

2. A system as claimed in claim 1 wherein the transmitting and the receiving fibres are mutually contained in a single flexibly sheathed cable.

3. A system as claimed in claim 2 wherein at least one multiplicity of the receiving fibres is disposed in annular array around at least one transmitting fibre.

4. A system as claimed in claim 3 wherein a multiplicity of the transmitting fibres is disposed in annular array coaxially alternated with the multiplicities of receiving fibres.

5. A system as claimed in any of the preceding claims wherein the claddings of the transmitting fibres and of the receiving fibres each have identical refractive indices.

6. A system as claimed in claim 5 further comprising a layer of optical coupling media between the transmitting and the receiving fibres.

7. A system as claimed in claim 2 further including an optical terminator located at one end of the cable, the pulsed light source and the light pulse detector both being located at the other end of the cable, whereby light pulses conducted through the transmitting fibres from the source are directed back into the receiving fibres for conduction to the light pulse detector.

8. A system as claimed in claim 7 further including an electronic processing means so connected and arranged as to indicate the location and duration of a region of microbending in the cable in response to the time interval separating the arrival at the light pulse detector of progenitor light pulses received from the source after passage through the total length of the transmitting and the receiving fibres, and of breakthrough light pulses received after passage through the transmitting and the receiving fibres only so far as the region of microbending, the breakthrough pulses having been separated from their progenitor light pulses at that region by passage through the claddings.

9. A system as claimed in claim 8 wherein the electronic processing means is further arranged to indicate the extent of the microbending in response to the amplitude of the breakthrough light pulses.

10. A system as claimed in claim 1, 2, 3, 4, 7, 8 or 9 wherein the pulsed light source operates at infra-red wavelengths.

11. A system as claimed in claim 5, wherein the pulsed light source operates at infra-red wavelengths.

12. A system as claimed in claim 6, wherein the pulsed light source operates at infra-red wavelengths.

* * * * *